US010214397B2

(12) United States Patent
Vallés Navarro et al.

(10) Patent No.: US 10,214,397 B2
(45) Date of Patent: Feb. 26, 2019

(54) DEVICE FOR FINE ADJUSTMENT OF THE COUNTERWEIGHT OF A TELESCOPIC FILMING CRANE

(76) Inventors: Alfredo Vallés Navarro, Cornellá de Llobregat (ES); Andrés Vallés Navarro, Cornellá de Llobregat (ES)

( * ) Notice: Subject to any disclaimer, the term of this patent is extended or adjusted under 35 U.S.C. 154(b) by 1011 days.

(21) Appl. No.: 13/148,509

(22) PCT Filed: Feb. 10, 2009

(86) PCT No.: PCT/ES2009/000074

§ 371 (c)(1),
(2), (4) Date: Aug. 9, 2011

(87) PCT Pub. No.: WO2010/092194

PCT Pub. Date: Aug. 19, 2010

(65) Prior Publication Data

US 2011/0309213 A1 Dec. 22, 2011

(51) Int. Cl.
*B66F 11/04* (2006.01)
*B66C 23/72* (2006.01)

(52) U.S. Cl.
CPC ..... *B66C 23/72* (2013.01); *B66F 11/048* (2013.01)

(58) Field of Classification Search
CPC ..... B66C 23/72; B66C 23/74; B66C 23/76; B66F 11/048; B66F 11/046
USPC ..... 248/424, 429, 187.1, 162.1, 123.11, 248/123.2; 212/347–350, 195–198, 212/298–301, 260–261; 396/428
See application file for complete search history.

(56) References Cited

U.S. PATENT DOCUMENTS

| | | | | |
|---|---|---|---|---|
| 2,156,862 | A | 5/1939 | Best et al. | |
| 4,943,019 | A * | 7/1990 | Mester | 248/123.11 |
| 5,033,705 | A | 7/1991 | Reagan et al. | |
| 7,128,479 | B2 * | 10/2006 | Chapman | 396/428 |
| 7,252,441 | B2 * | 8/2007 | Chapman | 396/428 |

FOREIGN PATENT DOCUMENTS

| | | |
|---|---|---|
| DE | 3334428 | 4/1985 |
| GB | 2422139 | 7/2006 |

* cited by examiner

*Primary Examiner* — Alfred J Wujciak
(74) *Attorney, Agent, or Firm* — Davis & Bujold PLLC; Michael J. Bujold

(57) ABSTRACT

A device for finely adjusting the position of the counterweight of a telescopic filming crane has an electronically controlled motor, acting on a secondary counterweight platform, which automatically finely adjusts the position of the counterweight as the crane's telescoping tubes are extended and retracted.

10 Claims, 2 Drawing Sheets

DEVICE FOR FINE ADJUSTMENT OF THE COUNTERWEIGHT OF A TELESCOPIC FILMING CRANE

FIELD OF THE INVENTION

The present invention develops a device for fine adjustment of the counterweight of a telescopic filming crane, such as the type of crane with telescopic mechanisms wherein unfolding and retraction thereof is compensated for by means of the displacement of counterweights with the aim of maintaining its balance, wherein by means of the generation of movement on an additional counterweight platform it is accomplished said precise adjustment of the balance in relation to the fulcrum of the telescopic crane.

PRIOR ART

Extensible telescopic cranes for filming cranes and the stability problems caused by the cameras that are supported at the ends of their jibs are known, as are known the problems arising from the balance of the crane assembly that the camera mechanism, and sometimes the operator himself, are to withstand.

For instance, U.S. Pat. No. 4,907,768 describes a telescopic crane provided with a plurality of segments and at whose end is located a camera or filming head that is balanced during the ascent movements of the crane. In said document the telescopic segments of the crane are associated with the extension/retraction mechanism of a counterweight located at the rear portion thereof, such that while the jib of the crane is being extended the counterweight becomes extended as well in an inverse movement with the aim of maintaining the balance of the crane in relation to the fulcrum thereof.

However, all telescopic cranes pose a problem in respect of the fine or precise adjustment of their balance at some portion of their path or extension. Due to the movement of the masses and the fact that the counterweight carriage extends beyond the support center of the arm at some point of the path, it is not possible to keep the crane perfectly counterbalanced, which on most occasions entails vibration of the crane caused by its extension and lack of uniform balance.

In the prior art it is used a mechanic system for movement of the counterweight carriage so that the operator adjusts the critical point and thus leaves the crane off-balanced at the point deemed to be the least critical for its control. There is provided a small circular weight that slides along a rod which is manually-controlled by an operator in order to adjust the position of the crane weights at all times.

The above solution poses several drawbacks. On the one hand, it is inconvenient for the operator to control the crane weights even when it has to hold greater weights. As a result of the above it turns out to be extremely difficult to accomplish proper initial and final crane movements. The operator is more likely to end up paying more attention to controlling crane weights than controlling crane movement.

Additionally, whenever the crane stops at a critical point there exist oscillations in the position of the crane arm caused by the operator having to counteract weight difference with his own effort.

Lastly, it is desirable an automatic means for effecting the balancing of the crane, thereby freeing the operator from such task.

The object of the present invention is to overcome said difficulties by providing a fine additional adjustment of the crane counterweight.

This and other advantages of the present invention will become more apparent throughout the appended description thereof.

BRIEF DESCRIPTION OF THE INVENTION

The present invention describes a device for fine adjustment of the counterweight of a telescopic filming crane, such as the type of crane with telescopic mechanisms wherein unfolding and retraction thereof is compensated for by means of the displacement of counterweights with the aims of maintaining its balance, wherein by means of the generation of movement on an additional counterweight platform it is accomplished said precise adjustment of the balance in relation to the fulcrum F of the telescopic crane.

The device of the invention thus includes a secondary counterweight platform, counterweights, a mechanic system for transmitting movement, a primary counterweight platform, a motor for actuating the mechanic system and several tubes and joints in the device.

By means of the above construction all the sought inventive objects are accomplished. For instance, through the automatic mechanism for displacement of the counterweight of the fine adjustment it is avoided the operator's tedious task of balancing the crane upon extension of the telescopic arm thereof. Additionally, accomplishing said balance in a more efficient manner results in a balancing of the crane movements thereby avoiding oscillations and shaking thereof.

BRIEF DESCRIPTION OF THE DRAWINGS

For a better understanding of the invention it is accompanied by two sheets of merely illustrative and non-limiting drawings.

DETAILED EXPLANATION OF THE INVENTION

Figure 1:
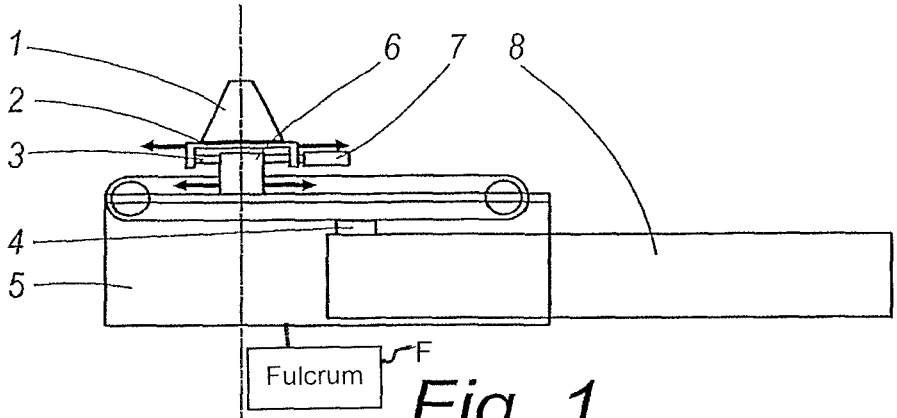
FIG. 1 illustrates a schematic view of a transverse section of the telescopic arms of the crane and the fine adjustment mechanism according to the preferred embodiment of the invention.

The present invention comprises a device for fine adjustment of the counterweight of a telescopic filming crane, such as the type of crane with telescopic mechanisms wherein unfolding and retraction thereof is compensated for by means of the displacement of counterweights with the aims of maintaining its balance, wherein by means of the generation of movement on an additional counterweight (1) platform (2) it is accomplished said precise adjustment of the balance in relation to the fulcrum of the telescopic crane.

The first tube or first telescopic arm (8) extending from the main tube (5) is coupled thereto by means of a joint (4) in accordance with any of the known means in the art.

According to the known art, the displacement of the first tube (8) in relation to the main tube (5), since there occurs the extension or retraction of the telescopic mechanism of the crane, involves a displacement of the counterweight (1) relative to said main tube (5).

According to the present invention, on a secondary counterweight platform (2) is attached a system for the transmission of movement (3) actuated by a motor (7). The invention is provided with electronic means for controlling, by acting on said motor (7), the movement of said means for transmitting movement (3) of said platform (2). Said means for transmitting movement (3) can be, for example, a stud, that displaces in a fine fashion the crane counterweight (1) in an additional adjusting movement of the overall movement of the known counterweight (1).

Figure 2:
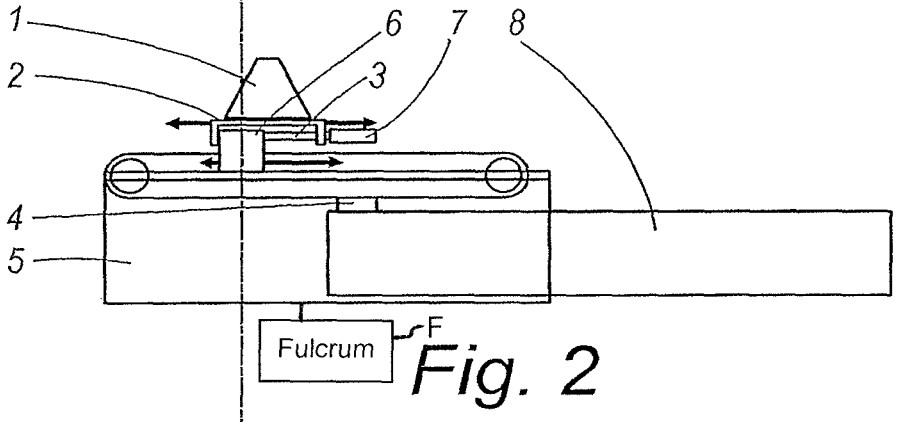
FIGS. 2 and 3 respectively illustrate two extreme occurrences of displacement caused by the action of the fine adjustment of the present invention, like in the embodiment of FIG. 1.
Figure 3:
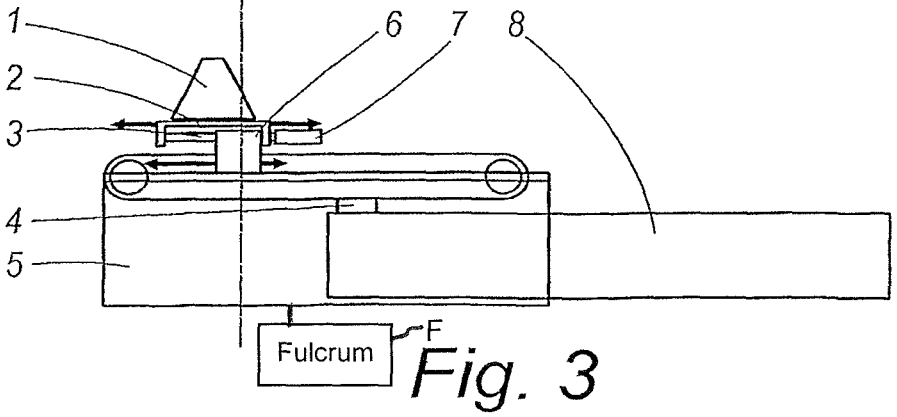

In the first possible embodiment of the invention, illustrated in FIGS. 1 to 3, such secondary counterweight platform (2) is positioned along the main tube (5) by the primary counterweight platform (6). The primary counterweight platform (6), as indicated above, moves relative to the movement of the tube or first telescopic arm (8).

Figure 4:
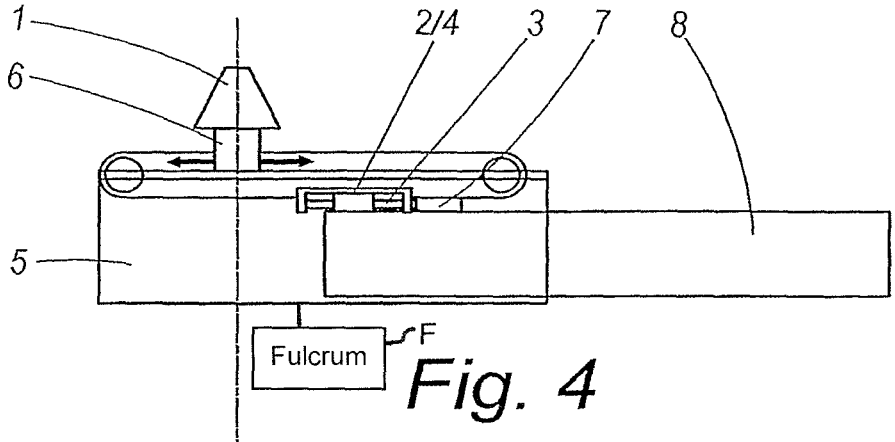
FIGS. 4 to 6 illustrate different occurrences of displacement of the fine counterweight adjustment of the present invention in another possible embodiment thereof, wherein the secondary platform is associated with the first tube.
Figure 5:
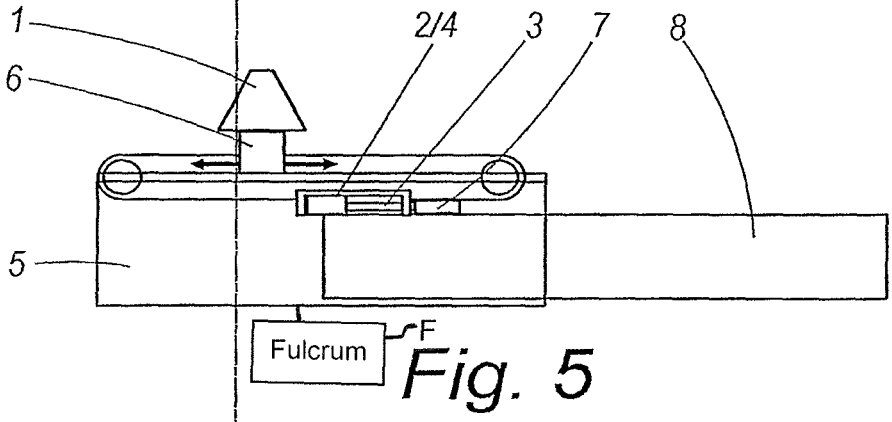
Figure 6:
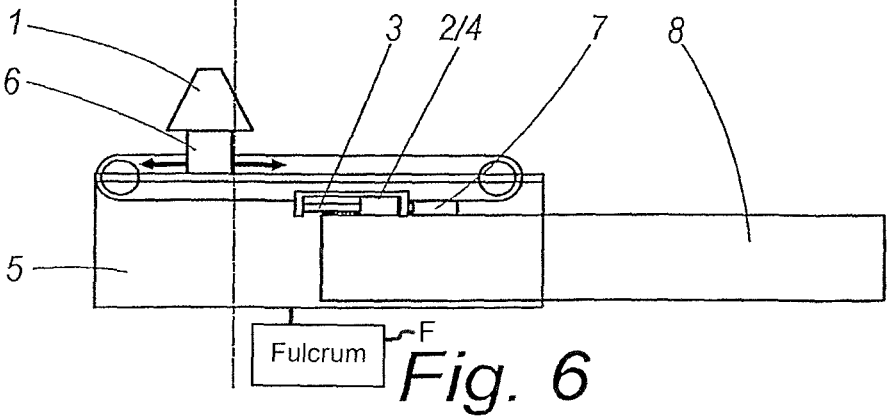

In another possible embodiment of the invention, as illustrated in FIGS. 4 to 6, said secondary counterweight platform (2) is associated with first tube (8). Broadly speaking, the functioning of the fine adjustment is similar in both embodiments.

During actual functioning, the device of the present invention, in each of its embodiments, requires a prior calibration operation based on the weight that the crane jib has to withstand and likewise adapted to the specific configuration of the features of each particular telescopic crane.

Such calibration process involves that for every starting point of the first tube (8) the operator marks a point of placement for the secondary counterweight platform (2) so as to provide the perfect counterweight to the difference of masses during the path. These displacement correspondences of the first tube (8) with a position of the counterweight platform (2) are stored in the control means of the device.

Once all the adjustments points are marked, it is actuated a function that has been pre-programmed in the control mechanisms of the device of the type "generator of movement of the secondary platform" and, automatically, the secondary counterweight platform (2) starts moving regardless of the path of the first tube (8), although always depending on said path, thereby it thus permitting and performing the automatic fine adjustment at all the path points of the crane according to the main goal of the present invention.

Actually, the process for calibrating the device is factory-supplied, so that the device of the invention can be delivered once calibrated to the user. Such factory-supplied calibration is accomplished through automatic means based on the manufacturing patterns of each production process. It may be necessary, on occasion, for the user to perform a further adjustment by using the above-described point per point calibration. Users always have the possibility of modifying the adjustments, recovering the factory-supplied adjustments, etc.

It is understood that finish or shape details in the present case are liable to variation provided that the essence of the invention is not altered.

The invention claimed is:

1. A filming crane of a type having a telescoping mechanism comprising:

a main tube and a telescoping first tube which can be extended and retracted within said main tube, a fulcrum supporting the main tube, a primary counterweight platform supporting a movable counterweight for compensating for extension and retraction of the telescoping mechanism, a mechanism for adjusting a position of the movable counterweight relative to the main tube to balance the crane during extension and retraction, and the mechanism for adjusting the position of the movable counterweight including a fine adjustment device, and the fine adjustment device comprising:

a secondary counterweight platform which is movable with respect to the primary counterweight platform, and a motor for moving the secondary platform with respect to the primary counterweight platform, a controller for controlling said motor so as to finely adjust the position of the movable counterweight and thus maintain balance of the crane about its fulcrum for different extension positions of the first tube relative to the main tube, and storing means for storing a plurality of pairs of positions of calibration of the fine adjustment device, wherein each starting point of the first tube relative to the main tube corresponds with a positioning point of said secondary counterweight platform.

2. The device according to claim 1, wherein selected displacements of said first tube and corresponding displacements of said secondary counterweight platform are stored by the controller.

3. The device according to claim 1, wherein said device, once calibrated, following instructions of said controller, automatically moves said secondary counterweight platform depending on a path of the first tube to perform the automatic fine adjustment at each path point of the crane.

4. The device according to claim 1, wherein said secondary counterweight platform is supported on said main tube by the primary counterweight platform.

5. The device according to claim 1, wherein the secondary counterweight platform is movable with respect to both the primary counterweight platform and the main tube.

6. The device according to claim 1, wherein the secondary counterweight platform is supported and carried by the primary counterweight platform so as to move when the primary counterweight platform moves, and, during fine adjustment, the secondary counterweight platform is movable relative to the primary counterweight platform.

7. The device according to claim 1, wherein the secondary counterweight platform couples the telescoping first tube to the mechanism for adjusting a position of the movable counterweight relative to the main tube.

8. The device according to claim 1, wherein the movable counterweight is directly supported by the secondary counterweight platform which is supported and carried by the primary counterweight platform so that both the movable counterweight and the secondary counterweight platform move during movement of the primary counterweight platform, and, during fine adjustment, the secondary counterweight platform and the movable counterweight move relative to the primary counterweight platform.

9. A filming crane of a type having a telescoping mechanism, the filming crane comprising:

a main tube, a fulcrum supporting the main tube, a telescoping tube being extendible and retractable within and with respect to the main tube, a primary counterweight platform being supported by the telescoping mechanism, and the primary counterweight platform supporting a movable counterweight which compensates for extension and retraction of the telescoping tube, a rotatable mechanism for adjusting a position of the movable counterweight relative to the main tube in order to balance the crane, and the rotatable mechanism for adjusting the position of the movable counterweight further including a fine adjustment device comprising a second counter weight platform which is movable with respect to the primary counter platform, a motor for inducing relative movement between the secondary platform and both the primary counterweight platform and the main tube, a controller electrically connected to the motor for controlling the motor and finely adjusting the position of the counterweight relative to the telescoping mechanism and thus maintain balance of the crane about its fulcrum for different extension positions of the first tube relative to the main tube, and the controller comprising storing means for storing a plurality of pairs of positions of calibration of the device, wherein each starting point of the first tube relative to the main tube corresponds with a positioning point of said secondary counterweight platform.

10. A filming crane of a type having a telescoping mechanism, the filming crane comprising:

a main tube, a fulcrum supporting the main tube, a telescoping tube being extendible and retractable within and with respect to the main tube, a primary counterweight platform and a secondary counter weight platform, which is movable with respect to the primary counter platform, both being supported by the telescoping mechanism, and a movable counterweight being supported by the primary counterweight platform, and the movable counterweight being movable to so as to compensate for extension and retraction of the telescoping tube, a rotatable mechanism for adjusting a position of the movable primary counterweight relative to the main tube in order to balance the crane, and the rotatable mechanism for adjusting a position of the movable counterweight further including a fine adjustment device comprising the secondary counterweight platform, a motor for inducing fine adjustment relative movement between the movable counterweight and one of the primary counterweight platform and the secondary counterweight platform, a controller electrically connected to the motor for controlling the motor and finely adjusting the position of the movable counterweight relative to the telescoping mechanism and thus maintain balance of the crane about its fulcrum for different extension positions of the first tube relative to the main tube, and the controller comprising storing means for storing a plurality of pairs of positions of calibration of the device, wherein each starting point of the first tube relative to the main tube corresponds with a positioning point of said secondary counterweight platform.

* * * * *